US006115003A

United States Patent [19]

Kozakoff

[11] Patent Number: 6,115,003

[45] Date of Patent: Sep. 5, 2000

[54] INFLATABLE PLANE WAVE ANTENNA

[75] Inventor: Dennis J. Kozakoff, 4349 Higborne Dr., Marietta, Ga. 30066

[73] Assignee: Dennis J. Kozakoff, Marietta, Ga.

[21] Appl. No.: 09/038,738

[22] Filed: Mar. 11, 1998

[51] Int. Cl.[7] ..... H01Q 15/20

[52] U.S. Cl. ..... 343/840; 343/915; 342/8; 342/10

[58] Field of Search ..... 343/703, 706, 343/840, 880, 881, 912, 915, 916; 342/6, 8, 10, 170, 171

[56] References Cited

U.S. PATENT DOCUMENTS

| | | | |
|---|---|---|---|
| H514 | 8/1988 | Burside et al. | 342/360 |
| 2,913,726 | 11/1959 | Currie et al. | 343/872 |
| 3,005,987 | 10/1961 | Mack et al. | 343/872 |
| 3,056,131 | 9/1962 | McCreary | 343/781 |
| 3,112,221 | 11/1963 | Price | 117/217 |
| 3,125,758 | 3/1964 | Koehler | 343/872 |
| 3,147,478 | 9/1964 | Bird | 343/765 |
| 3,170,471 | 2/1965 | Schnitzer | 135/1 |
| 3,413,645 | 11/1968 | Koehler | 343/872 |
| 4,521,780 | 6/1985 | Preikschat | 342/170 |
| 4,672,389 | 6/1987 | Ulry | 343/915 |
| 4,673,934 | 6/1987 | Gentry et al. | 342/8 |
| 4,755,819 | 7/1988 | Bernasconi et al. | 343/915 |
| 5,166,696 | 11/1992 | Rupp et al. | 343/171 |
| 5,285,213 | 2/1994 | Tusch | 343/915 |

*Primary Examiner*—Don Wong
*Assistant Examiner*—Tan Ho
*Attorney, Agent, or Firm*—Morris, Manning & Martin, LLP

[57] ABSTRACT

This invention is directed to a apparatus that includes an inflatable antenna reflector assembly for generating electromagnetic plane waves. The apparatus can be used in a variety of applications in which plane waves are beneficial, such as in a compact range to simulate the long-range behavior of a radar system to test a target for its radar signature. The inflatable reflector assembly of the apparatus includes a base, an arched frame mounted to the base, and an envelope-like cover that fits over the frame. The cover's front side is transmissive to electromagnetic waves, and its rear side is reflective to such waves. The apparatus can include a point source antenna feed, in which case the cover's reflective portion is made to be parabolic, or the antenna feed can be a line source, in which case the cover's reflective portion is spherical. The base can be rested directly on the floor or ground for support. Preferably, the base extends along the largest dimension of the inflatable assembly for enhanced stability, and/or the materials and dimensions of the apparatus are made so that its center of gravity is relatively low. The reflective portion of the cover can be made by inclusion of metal or alloy wires in a transmissive fabric material. Such wires also provide reinforcement so that the reflective portion does not distort from the desired configuration upon inflation. Alternatively, metal can be applied to a transmissive fabric or sheet material through flame-spraying or a curable coating to form the reflective surface. The metal material can be applied in a serrated pattern to inhibit edge effects that would otherwise adversely affect the quiet zone in which plane waves generated by the apparatus are undisturbed. Alternatively a round edge of reflective material can be configured to bound the outer curved edge of the cover's reflective portion to inhibit edge effects.

54 Claims, 7 Drawing Sheets

3
6
5
4
2
15
5
8
13
14
14
15
15
7
ELECTRO-
MAGNETIC
WAVE
GENERATOR
9
COMPUTER
10

INFLATABLE PLANE WAVE ANTENNA

CROSS-REFERENCE TO RELATED DISCLOSURE DOCUMENTS

This patent application claims earlier-filing benefits of Disclosure Document No. 428671 filed Dec. 24, 1997 and entitled "Inflatable Antenna Reflector for Use for Compact Antenna Range and Other Applications," and Disclosure Document No. 429670 filed Dec. 10, 1997 and entitled "Improved Inflatable Antenna Reflectors for Use for Compact Antenna Range and Other Applications," both naming Dennis J. Kozakoff as the sole inventor.

BACKGROUND OF THE INVENTION

1. Field of the Invention

The invented apparatus is directed to an inflatable antenna system useful for the generation of plane electromagnetic waves. The invented apparatus can be used for compact ranges, and in other radar applications in which plane waves are required, or are beneficial.

2. Description of the Related Art

Compact ranges are radar installations that are used to test the radar signature of various aircraft, rockets, missiles or warheads (sometimes referred to as 'targets') to create data that can be used to identify such objects when encountered by radar in military operations, in commercial aviation, or in aerospace applications. The radar systems used in a compact range generate plane electromagnetic waves that simulate the character of radar-generated waves at relatively large distances from the radar source. Thus, rather than having to test a target for its signature at relatively large distances from a radar installation, the target can be positioned relatively near the plane-wave generating radar source, and the target will reflect the plane waves so as to generate signature data similar to that which would be obtained if the target were observed by radar at typical distances remote from the radar source. Because the target can be placed near the radar source in a compact range, testing of targets for their respective radar signatures is greatly simplified. Specifically, the target can be easily oriented on a stand in various attitudes for repeated signature testing. The compact range thus provides greatly simplified target testing compared to the alternative of positioning the target at a remote site, or actually testing the target in flight, which requires remote communications and cumbersome coordination of the activities of more than one person to repeatedly reorient the target in different attitudes for testing. Thus, the compact range greatly simplifies the compilation of signature data for targets.

At present, all compact ranges known to the inventor are dedicated facilities, that is, the facilities are built for the sole purpose of use as a compact range. Of course, if the dedicated facility is not used at all times for compact range testing, it could potentially serve other uses and thus avoid wasteful spending on additional facilities for uses that could be housed in one multi-purpose building or carried out in a single outdoor range. It would be desirable to overcome this disadvantage of previous compact range installations.

Also related to the present invention is the current state-of-the-art in inflatable radar antenna systems. Examples of such inflatable antenna systems are disclosed in U.S. Pat. No. 2,913,726 issued Nov. 17, 1959 to J. W. Currie et al., U.S. Pat. No. 3,005,987 issued Oct. 24, 1961 to K. M. Mack et al., U.S. Pat. No. 3,056,131 issued Sep. 25, 1962 to R. L. McCreary, U.S. Pat. No. 3,112,221 issued Nov. 26, 1963 to H. C. Price, U.S. Pat. No. 3,125,758 issued Mar. 17, 1964 to R. J. Koehler, U.S. Pat. No. 3,147,478 issued Sep. 1, 1964 to W. W. Bird, U.S. Pat. No. 3,413,645 issued Nov. 26, 1968 to R. J. Koehler, and U.S. Pat. No. 4,672,389 issued Jun. 9, 1987 to David N. Ulry. Nearly all of the above-identified inflatable antennas are designed for field deployment in military applications, and as such are provided with systems to protect the antennas and their feeds from extreme weather conditions. To this end, several of the inflatable antenna systems disclosed in these patents have inflatable housings which enclose the antenna and feed. While these antenna and feed housings are desirable for field deployment, they are not well-adapted for use in a compact range in which such housings are a hindrance and present undue complication in assembly, use and disassembly. Also, these antenna systems are supported by relatively complicated support devices, many of which have the capability of rotating the inflatable antenna structure to scan the generated radar pattern over an azimuth range. Although these support structures may be desirable in military field deployment situations, they are not well-suited for compact range applications. Furthermore, the antenna feeds of these radar systems are housed within the inflatable reflector structure or are attached thereto in a relatively complicated fashion which is necessary to protect the feeds and to assure that the feed is properly positioned and will work properly upon deployment with little or no time required for adjustment. Although such housing and positioning of the feed may be desirable in field deployment, it can be a hindrance to testing in a compact range application. In addition, although many of the above-mentioned inflatable antenna systems are designed for portability, they nonetheless require considerably more time, effort, and complication in assembly, use, and disassembly than is desirable in a compact range application. It would be desirable to overcome these disadvantages of previous inflatable radar antenna systems.

SUMMARY OF THE INVENTION

The invented apparatus overcomes the above-noted disadvantages. The invented apparatus includes an inflatable radar antenna assembly that generates plane electromagnetic waves. The apparatus includes a base having a planar surface that rests on a level surface, such as a floor of a building, or smooth ground. The invented apparatus also includes an elongated frame that has two ends mounted at respective spaced positions to the base. The frame extends upwardly from the base in a substantially circular, arch-like configuration. The invented apparatus also includes a cover that is supported by the frame, and that has a peripheral portion that is attached in at least a partially air tight manner to edge portions of the base. The cover is preferred to be a flexible sheet-like material, at least partially air-tight, that has an electromagnetic-wave reflective portion extending between the base and the frame on one side of the frame, and an electromagnetic-wave transmissive portion extending between the base and the frame on the opposite side of the frame. The invented apparatus also includes a pressurized gas source that is coupled to communicate with a space enclosed by the cover and the base. The pressurized gas source inflates the cover so that the rear reflective portion assumes a predetermined smoothly-curved shape such as a parabolic or spherical configuration useful as a radar antenna reflector. The invented apparatus can also include an antenna feed positioned at the focal point of the cover's reflective portion, in which case the surface of the reflective portion has a parabolic configuration. Alternatively, if the cover's reflective portion has a surface that is spherical in configuration, the antenna feed can be a line feed fixed to the base, that extends along the symmetrical axis of the spherical surface of the cover's reflective portion.

The base and frame can be composed of a variety of molded, extruded, cast, cut or otherwise machined materials, including plastic and metals, especially relatively light types such as aluminum, which provide strength and which are lightweight for enhanced portability of the invented apparatus. The base can be composed of a planar, slab-like piece of material, and the frame can be composed of a tube bent to form the arch configuration. The two ends of the frame can be secured to the base by weldments, fusings, adhesive or brackets. The base can be provided with a curved rear edge portion to which the peripheral edge of the reflective cover portion can be attached. The base's rear edge portion can be parabolically or circularly curved to support, together with the frame, the cover's reflective portion in a parabolic or spherical configuration.

The electromagnetic-wave-reflective portion of the cover is preferably composed of a non-stretchable sheet-like material such as a fabric, so that it does not distort from the desired shape if overinflated to a degree. The material can be made non-stretchable through inclusion of Thornel ultra-high modulus carbon fibers, synthetic material produced under the trademark Kevlar, silk, fiberglass, metal, alloy or other relatively strong strands or wires in the material or fabric matrix. The cover's reflective portion can be made reflective to operational electromagnetic wave frequencies generated by the antenna feed (which can be in a range from a fraction to $10^{12}$ Hertz) in several ways. For example, the electromagnetic-wave-reflective portion of the cover can be composed of a non-stretchable material flame-sprayed with a metal such as zinc. If the material is made of plastic, flame-spraying provides the advantage of melting the plastic to a degree so that the metal is fused into the material's plastic matrix. Alternatively, a curable metal-containing coating or paint can be used to apply a reflective metal to an otherwise transmissive material. Preferably, the metal-containing curable substance is non-oxidizing so that its electromagnetic reflective performance will not be degraded upon exposure to the atmosphere. Another alternative to render the material reflective is to include metal fibers in the material matrix. The metal fibers can also provide the strength to render the material non-stretchable.

At least the reflective portion of the cover can be made of a plurality of approximately triangular or otherwise shaped sheet-like material pieces joined together at adjacent peripheral edges so that the reflective portion forms the desired shape upon inflation. In one embodiment, a mold release substance can be applied to a mandrel or mold of the desired parabolic or spherical shape, and alternating layers of curable plastic substance such as urethane, and non-stretchable material such as carbon, silk, fiberglass or Kevlar synthetic material fabric, can be stacked to form a composite structure that forms the desired parabolic or spherical shape upon inflation. In a second embodiment, the material pieces can be joined by an adhesive, sewing or by fusing adjacent edges together. Because the edges of the material pieces are overlapped to a degree to join them together, the alternative of using metal fibers in material to provide reflective behavior is less preferred in this option for making the cover because the metal density varies between overlapping and non-overlapping portions of the material pieces composing the cover's reflective portion and creates non-uniform reflective characteristics. On the other hand, flame-spray or a curable metal-containing coating can be readily applied uniformly, and therefore, are alternatives for providing electromagnetic-wave reflectivity that are generally preferred over metal-fiber-containing materials.

Constraints on the non-reflective front portion of the cover are less stringent than upon the rear reflective portion thereof. The cover's front portion should be transmissive and non-refractive to electromagnetic-waves at the operational frequency of the antenna feed. Most non-metal sheet materials or fabrics satisfy this requirement. The cover's front portion can be stretchable as its shape has no bearing on the electromagnetic wave reflective characteristics of the cover's rear portion. The cover should be at least somewhat air tight or restrictive to the passage of air to permit the cover to be inflated so that the reflective rear portion of the cover assumes the desired shape. The front and rear portions of the cover can be attached together about their peripheral edges by sewing, adhesive, or fusing. Alternatively, or in addition, the cover's front and rear portions can be attached to the frame by sewing, adhesive, or fusing, or with fabric loops attached to the cover and through which the frame extends. The cover is also attached about its periphery to the peripheral edge of the base so as to produce an enclosure that is sufficiently air-tight to allow its inflation.

The dimensions and weight of the base, frame and cover are preferably selected so that the center of gravity of the apparatus upon assembly and inflation, is less than one-half of the distance from the base to the frame's apex so that the apparatus will not tend to fall over. Stability of the apparatus can be achieved by limiting the dimensions of the frame so that it extends over 180° of arc or less relative to its center of curvature, and also by forming the base so that it extends over the largest dimension of the apparatus.

The invented apparatus can also include features to counter edge effects of the cover's reflective portion to enhance the size of the so-called 'quiet zone'of the reflector. In the quiet zone, the plane waves generated by cooperation of the antenna feed and reflective portion of the cover are relatively undisturbed so that target testing can be performed therein. A large quiet zone is generally advantageous in that it defines a commensurably large area for target testing. Edge effects that limit the size of the quiet zone can be countered in the invented apparatus by forming a serrated pattern at the edge portions of the cover's reflective portion. The serrated pattern of the cover can be formed by alternating electromagnetic-wave-transmissive portions and electromagnetic-wave-reflective portions of the cover. For example, this can be done with a triangular or tapered shield that blocks portions of the cover during application of metal material to the cover by curable coating or flame-spraying. Alternatively, for fabric with metal fibers or material therein, triangular pieces of non-reflective or absorptive material can be joined to the reflective portion of the cover to reduce edge effects. Another approach to eliminating edge effects is to provide the reflective portion of the cover with a rounded reflective edge. This option can be achieved with an inflatable frame made of reflective material, that has a tube configuration that is attached to the cover, and from which the cover hangs. In any case, either the serrated pattern or rounded reflective edge can reduce edge effects significantly to increase the useful size of the apparatus's quiet zone.

The invented apparatus can also include at least one strip attached to the base to secure the periphery of the cover to the edge portions of the base. The strip can be attached to the base with screws extending through the strip and the cover, and into the edge portions of the base. The strip(s) secures the cover to the edge portions of the base over a relatively wide area so that the seal between the cover and base is at least approximately airtight to allow the cover's reflective portion to be inflated, and so that the cover is secured over a broad area so that it will not tend to rip if accidentally contacted.

To ensure proper positioning of a point source antenna feed used with a parabolic reflective cover portion, the apparatus can include two spaced blocks mounted to the front edge portion of the base. The apparatus can also include a beam with one end fitted between the blocks, and an opposite end upon which the antenna feed can be mounted. The beam and blocks can be used to properly position the feed at or near the focal point of the parabolic reflective portion of the cover. For the case in which the cover has a spherical reflective portion, the apparatus can include a line antenna feed positionally fixed to the base and oriented so as to extend at least approximately along a central axis of the spherical surface. In either configuration, the antenna feed directs electromagnetic waves to the reflective portion of the cover, which reflects the waves in a manner that generates waves that have at least approximately planar wavefronts. These planar wavefronts simulate the effect occurring when a target at a typical remote distance from a radar site encounters electromagnetic waves generated by such site. The planar waves generated by the apparatus are accordingly useful to compile radar signature data that identifies a particular target in different orientations relative to the radar source.

The pressurized gas source can include a pressure regulator to control the gas pressure in the space enclosed by the cover and the base to a predetermined pressure level that assures that the reflective portion of the cover conforms to the required shape. For example, the pressurized gas source can be an air pump or a pressurized gas tank, preferably with a pressure regulator to control the gas pressure within the space enclosed by the cover and base. The pressurized gas source can be coupled in communication with the space enclosed by the cover and base by a hose or tube, for example.

These together with other objects and advantages, which will become subsequently apparent, reside in the details of construction and operation of the invented apparatus as more fully hereinafter described and claimed, reference being had to the accompanying drawings, forming a part hereof, wherein like numerals refer to like parts throughout the several views.

DESCRIPTION OF THE PREFERRED EMBODIMENTS

Figure 1A:
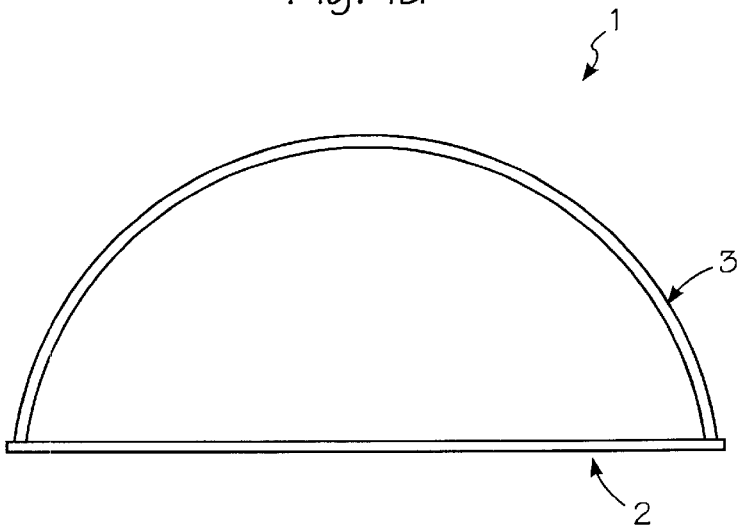
FIGS. 1A, 1B, and 1C are front and side elevation views, and a top plan view, respectively, of an exemplary base and frame assembly of the invented apparatus.
Figure 1B:
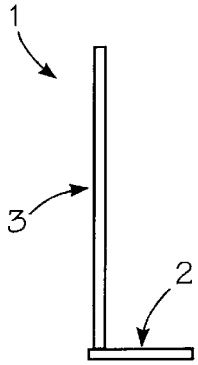
Figure 1C:
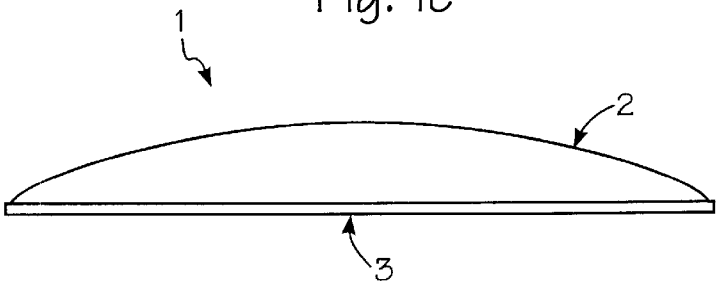

In FIGS. 1A, 1B and 1C, a portion of an apparatus 1 of this invention includes a base 2 and a frame 3. The base has a planar surface that can be rested upon a level surface such as a floor of a building that is to house a compact range, or smooth ground in the case of an outdoor compact range. The base can be planar or slab-like in shape, preferably with upper and lower major surfaces, a parabolically- or circularly-curved rear edge portion and straight front edge portion. The base is formed from a particular material and with sufficient size so that the base is heavy enough to stably support the apparatus, and that is also sufficiently light in weight to allow the apparatus to be portable. Exemplary materials that satisfy these criteria include many types of plastics, and some metals or alloys, particularly lightweight types such as aluminum. Fiberglass, aluminum or other honeycomb construction can be used to formed the base. Honeycomb construction includes a structural honeycomb mesh of materials such as fiberglass or other plastic, or metal, that is enclosed by sheets of the same or similar materials on the sides and edges thereof. Honeycomb construction for the base generally provides the advantages of relatively lightweight for portability due to the air pockets created by the honeycomb mesh, together with relatively high-strength due to the honeycomb configuration. Metals are only acceptable for use in the base if they are types that do not adversely interact with the electromagnetic wave frequencies intended for use with the apparatus. If made of a plastic material, the base can be molded, extruded or cut from a larger piece of material to form the base. If made of a metal, the base can be cast, or cut or otherwise machined from a larger piece of material. In size, the base can be on the order of one to a few tens of meters along its front edge portion, and a few to tens of centimeters in thickness. Preferably, the base extends along the largest dimension of the apparatus for stability. Also, the base is at least 100% larger than the size of the quiet zone for planar electromagnetic waves that are desired to be generated with the apparatus.

The frame 3 is preferably an elongated plastic, metal (e.g., aluminum) or alloy tube that is bent to form a circularly-shaped arch. The two opposite ends of the frame are secured to the base at spaced positions thereon, preferably in close proximity to the extreme outer corners of the base that are formed on both sides of the base where the base's front edge portion meets its curved rear edge portion. The ends of the frame can be fitted in sleeve fashion into bores formed in the upper major surface of the base and/or welded, fused, or adhered to the base. Heliarc welding can be used to join the base and frame if made of aluminum. Ultrasonic welding, fusing through the application of heat if the frame and base are composed of plastic, or many different types of adhesives including a suitable epoxy, can be used to join the ends of the frame to the base if made of plastic material. Alternatively, brackets, screws or bolts can be used to attach the frame ends to the base. In approximate configuration, the frame can be viewed as a section of a circle with a center of curvature positioned underneath the base (that is, on the opposite side of the base relative to the side on which the frame is positioned) so that the frame extends in an arc 180° or less relative to the center of curvature. As so configured, the frame has a relatively low center of gravity. Also, the base is preferred to extend along the largest dimension of the apparatus, so that the center of gravity of the apparatus is relatively low and will not tend to tip over if contacted.

As shown in the first embodiment of the apparatus 1 in FIGS. 2A, 2B, 2C, and 2D, the apparatus 1 also includes a cover 4 that is supported by the base and frame of FIGS. 1A–1C. The base and frame are illustrated in broken line in the embodiment of FIGS. 2A–2D to signify that they are positioned underneath the cover in these views. The cover is shown in its inflated state. The manner of inflation of the apparatus I and the equipment used therefor will be described in a later section of this description with reference to FIGS. 2E and 2F. The cover 4 includes a front portion visible in FIG. 2A that extends between the frame and the front edge portion of the base. The front portion of the cover is transmissive to electromagnetic waves at the operational frequency(ies) generated by the antenna feed (not shown in FIGS. 2A–2D) of the apparatus 1. The rear portion of the cover 4, best seen in FIG. 2B, includes a portion 5 that is substantially reflective to electromagnetic waves at the operational frequency(ies) of the apparatus. In the embodiment of FIGS. 2A–2D, the cover 4 also includes a serrated pattern 6 that helps to prevent edge effects at the operational frequency(ies) of the apparatus. The serrated pattern 6 is formed by alternating non-reflective or absorptive, and reflective areas on the cover. The serrated pattern enhances the size of the apparatus'quiet zone in which the electromagnetic waves generated by the apparatus are substantially planar and can be used to test a target.

Figure 2A:
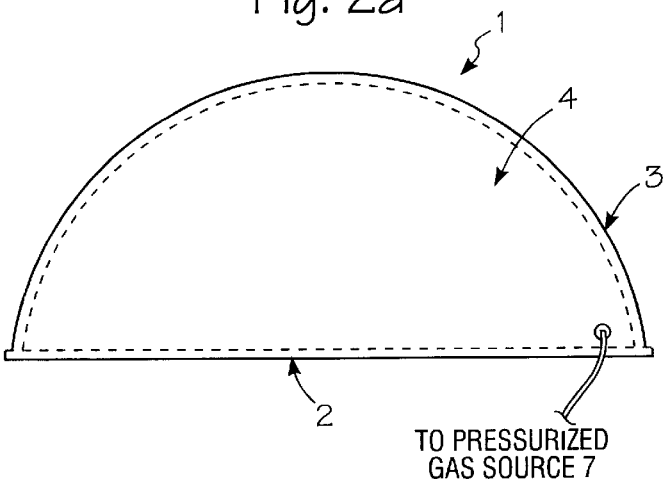
FIGS. 2A, 2B, 2C, 2D, 2E and 2F are front, rear and side elevation views, a top plan, detailed side elevation and perspective views, respectively, of a first embodiment of the invented apparatus.
Figure 2C:
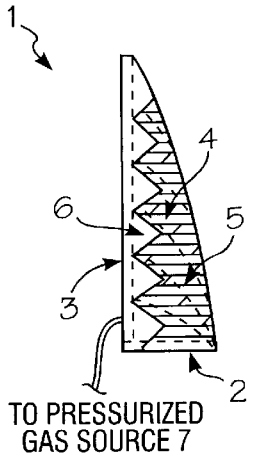
Figure 2B:
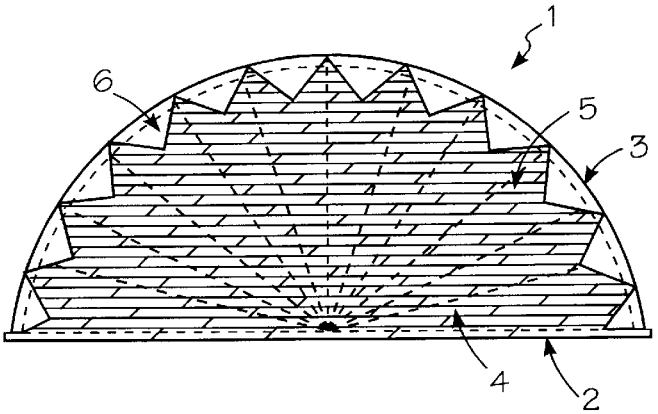
Figure 2D:
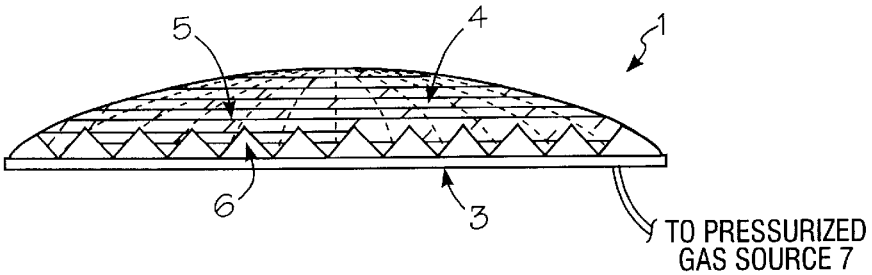

The cover preferably has an envelope- or pocket-like configuration defining an open end that fits over the frame. The periphery of the cover's open end is secured to the front and rear edge portions of the base to enclose the space between the cover and base in at least an approximately air-tight manner. The cover can be made of a material that is flexible and sheet-like, such as a plastic or fabric sheet material that is at least approximately impervious to the passage of air. Many kinds of commercially-available plastic sheet materials or fabrics with plastic or natural fibers can be used to form the cover. Preferably, the rear portion of the cover is non-stretchable so that the rear portion of the cover does not distort from the desired parabolic or spherical shape upon inflation. The desired non-stretchable characteristic of the cover's rear portion can be attained by the inclusion in the material or fabric matrix of relatively strong fibers or wires such as Thornel ultra-high modulus fibers commercially available from Amoco Performance Products, Inc. of Greenville, S.C., synthetic material produced under the trademark Kevlar, silk, metal or alloy, for example. Alternatively, a reinforcing mesh of such fibers or wires can be attached or adhered to a sheet forming the rear portion to provide the desired non-stretchable characteristic. In addition to providing non-stretch behavior, metal or alloy wires can be used in the cover's rear portion for electromagnetic-wave reflectivity. The cover can be formed from two sheet pieces joined together along their edges at or near where the cover is to meet the frame, but left unattached at the bottom portion to form the open end whose periphery is to contact the base's edge portions. Alternatively, to form the desired parabolic or spherical shape, the rear portion of the frame can be composed of two or more triangular- or otherwise-shaped pieces joined together at their edges, as can be seen in FIGS. 2B–2D. The pattern for the pieces can be made by using a parabolically- or spherically-shaped surface, such as that of an actual antenna reflector of the desired size, as a mandrel or model upon which to make and trim material pieces so that they will have the desired shape when joined together. Alternatively, a miniature clay model of the antenna reflector surface can be prepared and scanned with a video camera into a computer running an application program such as Autocad® from which the pattern for cutting the pieces from a sheet of material can be prepared. The edges of the material pieces can be joined together by heat fusing if made of plastic material, or by sewing or adhering such pieces together. The preparation of a pattern, and cutting and assembly of the material pieces can be performed by a variety of commercial sources, including Anthony's Inflatables, Inc. of Tampa, Fla. or Aerostar International, Inc. of Sioux Falls, S.Dak. As a second embodiment of the reflective portion of the cover, a parabolically- or spherically-shaped surface is used as a mandrel or mold, and a mold release substance is applied thereto. A layer of curable plastic material such as urethane can be applied to the mold-release-treated mandrel or mold surface of the desired parabolic or spherical shape, and triangular pieces of non-stretchable material such as silk, synthetic material produced under the trademark Kevlar, fiberglass, carbon or other material forming the desired parabolic or spherical surface can be set in the curable plastic material. This process can be repeated to form a plurality of alternating plastic and triangular material piece layers on the mandrel or mold. When cured, the resulting composite layered material is flexible and thin, preferably on the order of 0.05 to 0.06 inches in thickness, yet relatively unstretchable due to the presence of the silk, synthetic material produced under the trademark Kevlar, fiberglass, carbon or other non-stretchable material, and is also wear-resistant and at least approximately air-tight due to the presence of the plastic material. Such composite layered material can be manufactured by a commercial source such as Custom Coated Components, Inc. of Summerville, S.C. Upon inflation, the composite material of the cover's rear portion forms the desired parabolic or spherical shape.

As previously mentioned, the cover's rear portion can be made reflective through the use of sheet material that has a mesh of metal or metal alloy fibers or wires or other strand material that are reflective to electromagnetic waves, at least those at the operational frequency(ies) of the apparatus. The use of metal or alloy strands, however, is not preferred where the rear portion is composed of overlapping pieces of material, because the non-uniformity metal in the overlapping and non-overlapping portions of the cover's rear portion leads to non-uniform, undesirable electromagnetic performance. Whether the rear portion of the cover is made of a single piece of material, is formed by joining material pieces together, or is formed by layering material pieces and curable plastic material, the following two options can be used to apply reflective material to the rear portion of the cover if the cover is made of a transmissive starting material. One option is to use flame-spraying to apply an electromagnetic wave reflective metal such as zinc to the transmissive material composing the cover's rear portion. Such flame-spraying techniques are well-known, and can be used with particularly excellent effect if the transmissive material of the cover's rear portion is made of plastic material, in which case the flame-spraying melts the surface of the rear portion to a degree and allows the metal to diffuse into the cover's rear portion. Upon cooling, the metal is contained within the surface of the cover's rear portion. Another alternative is to spray or brush a curable metal-containing substance such as a paint or adhesive system, onto the cover's rear portion. Such metal-containing substances are commercially-available, and include, for example, the Series 599-A8574-1 Concentrate Lightning Guard or the Series 599-Y1306 Concentrate Antenna Copper Conductive Coating available from Engineered Industrial Coatings, Inc. of Mount Vernon, N.Y. The serrated pattern 6 formed by alternation of reflective and non-reflective materials about the curved edge of the cover's rear portion, can be applied using a triangularly-shaped shield to block transmissive portions of the serrated pattern during flame-spraying or application of the curable metal-containing substance. Alternatively, triangularly-shaped pieces of electromagnetic-wave-transmissive or absorptive material can be interleaved with reflective material portions if the reflective and transmissive portions of the cover's rear portion are cut and sewn, adhered or fused together in an appropriate fashion, such as that shown in FIGS. 2B–2D.

Because the cover's front portion is transmissive to the electromagnetic waves generated by the apparatus's antenna feed, its shape is relatively unimportant to the electromagnetic wave behavior of the apparatus. For simplicity in manufacture, the cover's front portion is preferably cut in a half-moon configuration from a piece of approximately air-tight material and sewn, adhered or fused at its curved edge to the corresponding edge of the cover's rear portion.

Figure 2E:
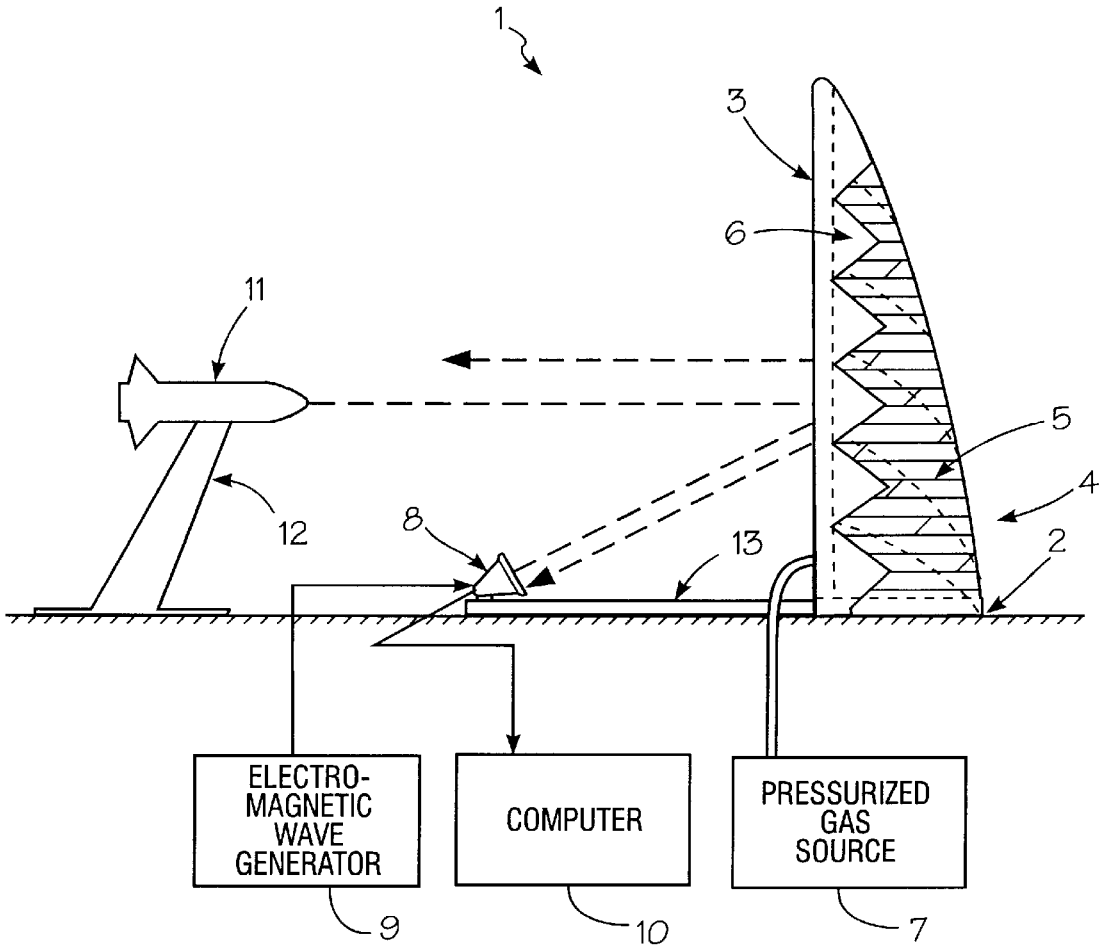

FIG. 2E is a side elevation view of the apparatus of FIGS. 2A–2D. In addition to the components indicated in FIGS. 2A–2D, the apparatus 1 of FIG. 2E includes a pressurized gas source 7, an antenna feed 8, an electromagnetic wave generator 9, and a computer 10. The pressurized gas source 7 is coupled in communication with the interior space enclosed by the cover 4 and the base 2 through a hose or tube that is connected to the source and has an end extending through the cover in a sealed, airtight manner. The source 7 supplies pressurized gas to the space enclosed by the cover and base to inflate the cover 4. In the embodiment of FIG. 2E, the cover's reflective rear portion 5 assumes a parabolic configuration upon inflation. Preferably, the pressurized gas source includes a pressure regulator or other device to regulate the pressure of the gas inside of the cover 4 to a pressure sufficient to inflate the cover's rear portion to form a smooth surface in the cover's rear portion that is parabolic (or nearly so) in the embodiment of FIG. 2E.

The antenna feed 8 is arranged at the focal point of the cover's parabolic reflective portion. The antenna feed is electronically coupled to the generator 9 which produces electromagnetic waves for supply to the feed. The feed emits the electromagnetic waves from a point or near point source so that the electromagnetic wavefront is spherical, or nearly so. The spherical wavefront generated by the antenna feed impinges upon and is reflected by the cover's rear portion to generate a planar wavefront. The planar wavefront simulates the electromagnetic wavefront generated by a radar system observing a target at normal distances on the order of at least a kilometer therefrom, and can thus be used to test a target such as an aircraft, rocket, missile or warhead for its radar signature in different orientations. For example, a target 11 can be placed on a stand 12 within a few to several tens of meters from the base-frame-cover assembly. Reflections from the target reflect again from the cover's reflective rear portion and can be detected by the antenna feed that generates a signal based on the received electromagnetic waves. The signal generated by the antenna feed represents the signature of the target. The computer 10 can be coupled to the signal generated by the antenna feed, and used to store the target's signature. By positioning the target 11 in different attitudes and recording the signature with the computer, a complete signature profile can be obtained for the target. The signature profile can be output from the computer 10 for supply to radar installations that can compare return signals with the signature data generated by the invented apparatus to identify and determine the orientation or bearing of a target.

Figure 2F:
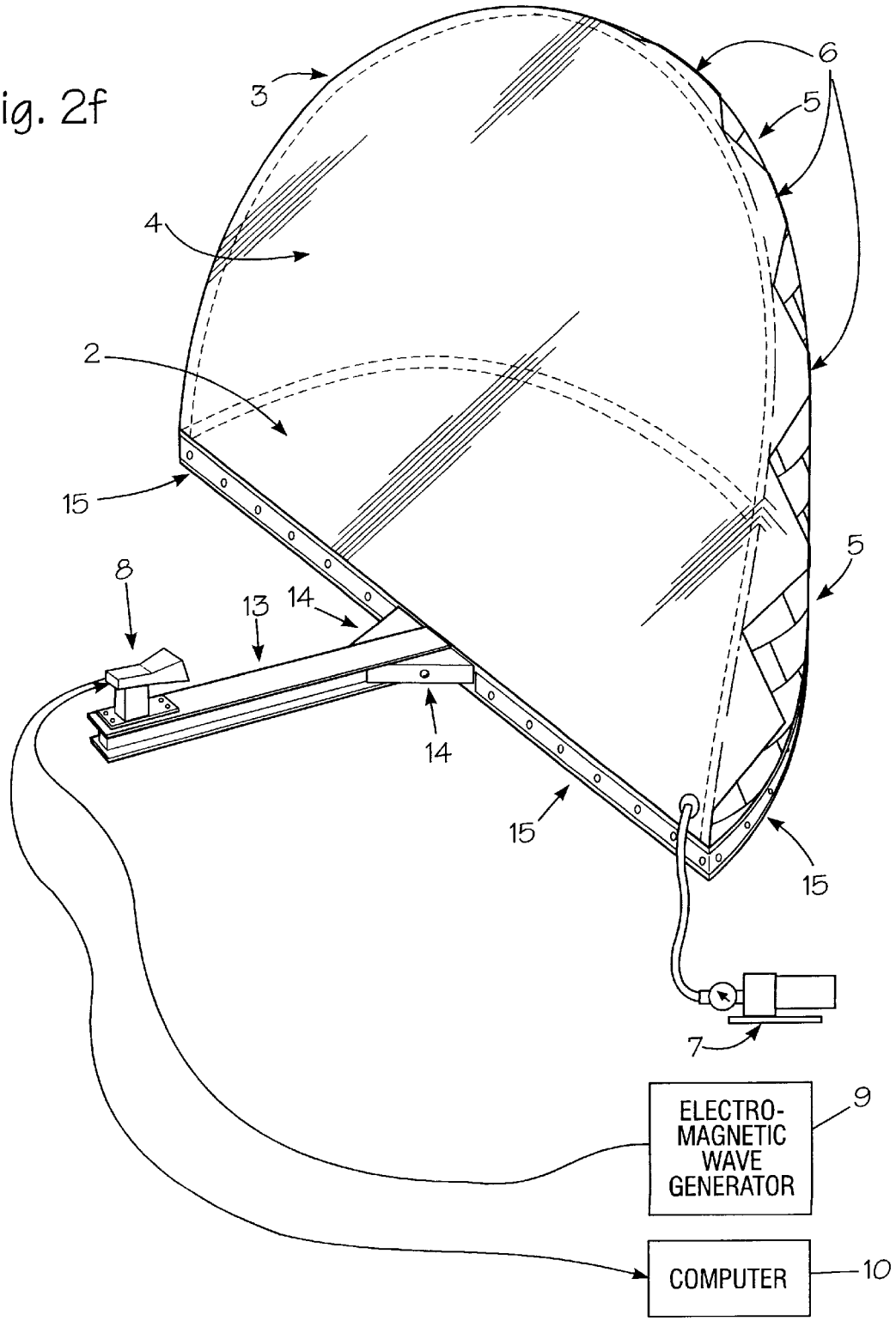

To facilitate orientation of the antenna feed with respect to the reflective portion of the cover, an elongated beam 13 can be used. The beam has one end in contact with the front edge portion of the base, and a second opposite end upon which is mounted the antenna feed. FIG. 2F shows the beam 13 in more detail. The beam can be an I-beam that is slid between a pair of triangular blocks 14 that are attached on either side of the center of the front edge portion of the base 2. The blocks serve to fix the position of the beam 13. By properly mounting the antenna feed to the opposite end of the beam, the feed can be assured to be at or nearly at the focal point of the reflective rear portion of the cover.

Also, in FIG. 2F, the peripheral edge of the cover 4 is fixed to the front and rear edge portions of the base with strips 15. The strips are secured by screws or the like into the base so that the cover's peripheral portion is held between the strips and the base. The relatively large area of the strip helps to secure the cover to the base in an air-tight manner, and over a broad area so that the cover will not tear if contacted.

Preferably, the weight and dimensions of the base 2, the frame 3 and the cover 4, are made so that the center of gravity of the apparatus 1 is at a height that is less than one-half of the distance from the base to the frame's apex so that the apparatus I will not tend to fall over. This can be accomplished in part by forming the frame so that it extends 180° of arc or less relative to its center of curvature, and also by forming the base so that it extends along the largest dimension of the apparatus. Constructing to the base so that it has more weight than the frame and cover also helps to stabilize the apparatus.

Figure 3A:
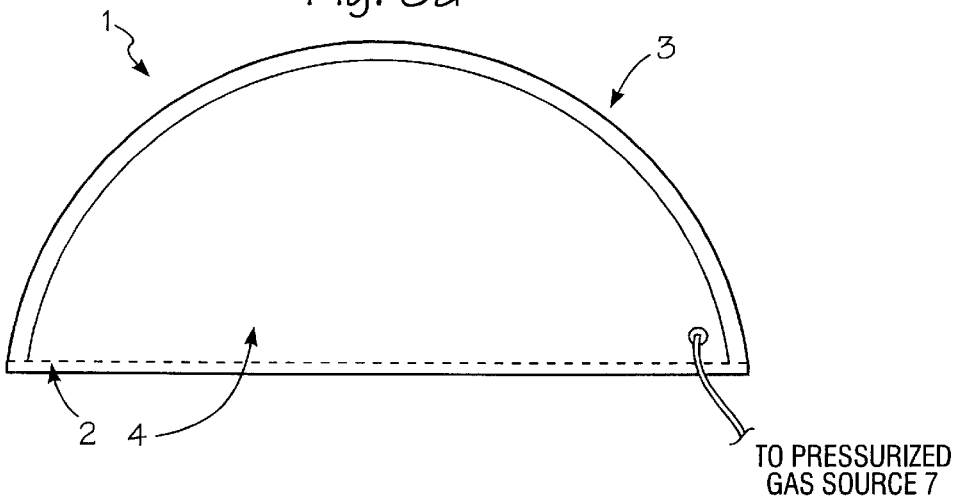
FIGS. 3A, 3B and 3C are front elevation, top plan and detailed side elevation views, respectively, of a second embodiment of the invented apparatus.
Figure 3B:
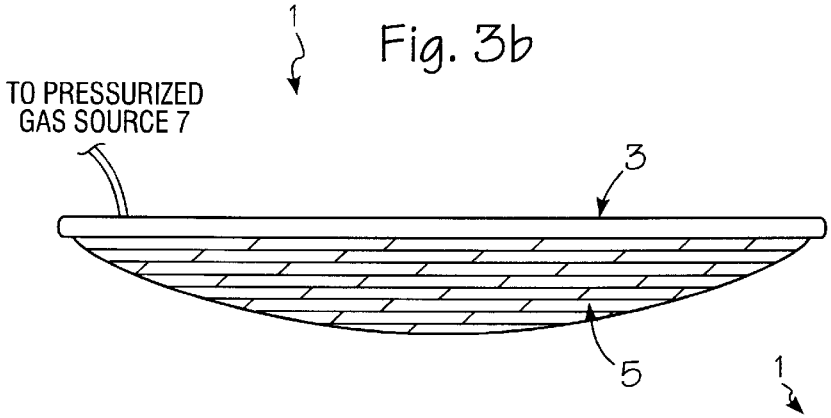
Figure 3C:
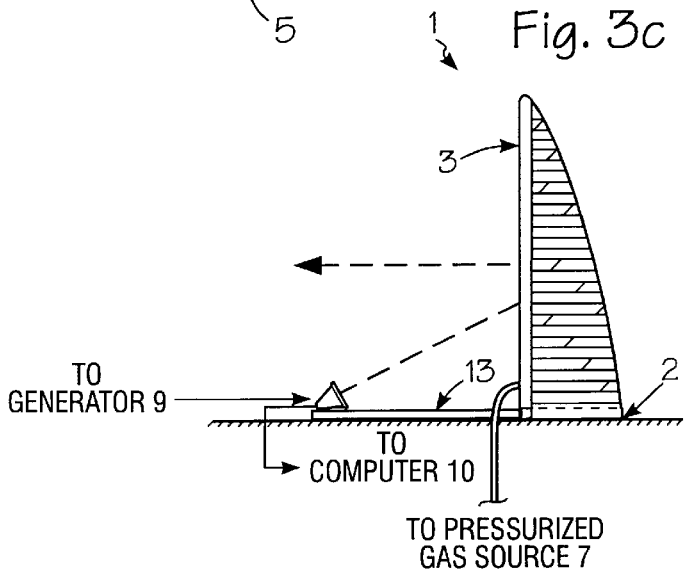

In FIGS. 2A–2F, the quiet zone of the planar waves generated by the apparatus is enhanced by the presence of the serrated pattern 6. FIGS. 3A–3C illustrate another option for preventing edge effects to achieve enhancement of the quiet zone's size. In FIGS. 3A, 3B, and 3C, the frame 3 is tube-like in shape, and is made of electromagnetic wave reflective material. Because of its roundness, the frame 3 alleviates edge effects that would otherwise reduce the size of the quiet zone. The frame 3 can be inflatable and attached by its ends or with dependent flanges, for example, to the base. In other respects, the embodiment of FIGS. 3A, 3B, and 3C can be similar to that of FIGS. 2A–2F.

Figure 4A:
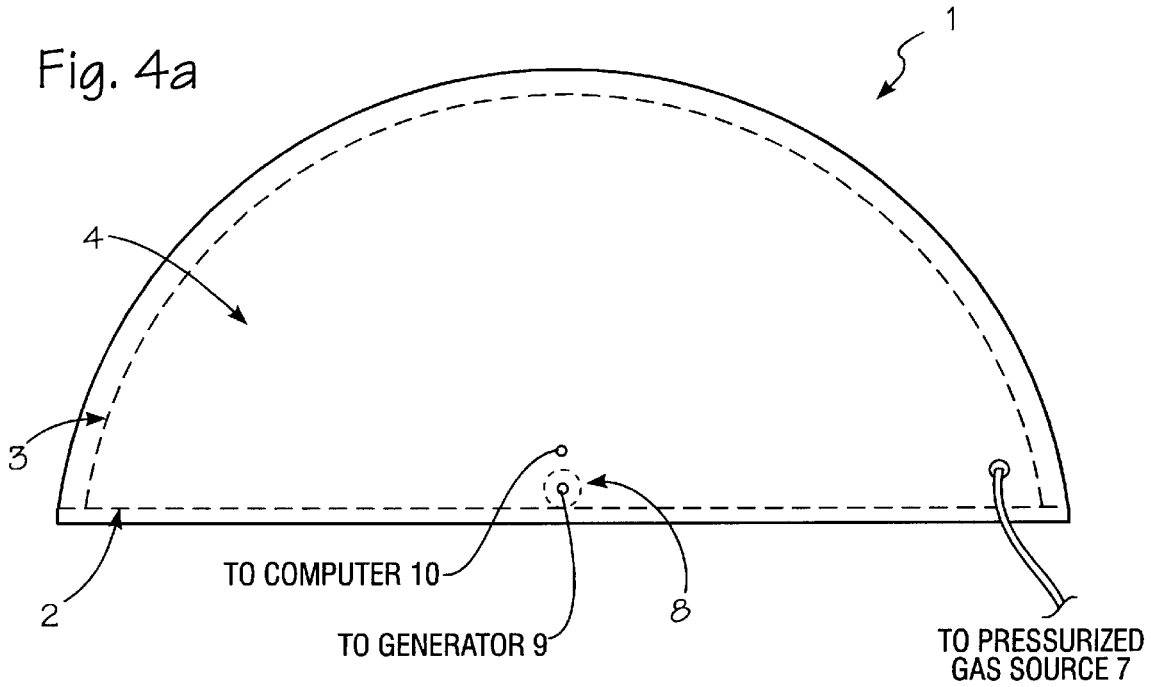
FIGS. 4A, 4B and 4C are front elevation, top plan and side elevation views, respectively, of a third embodiment of the invented apparatus.
Figure 4B:
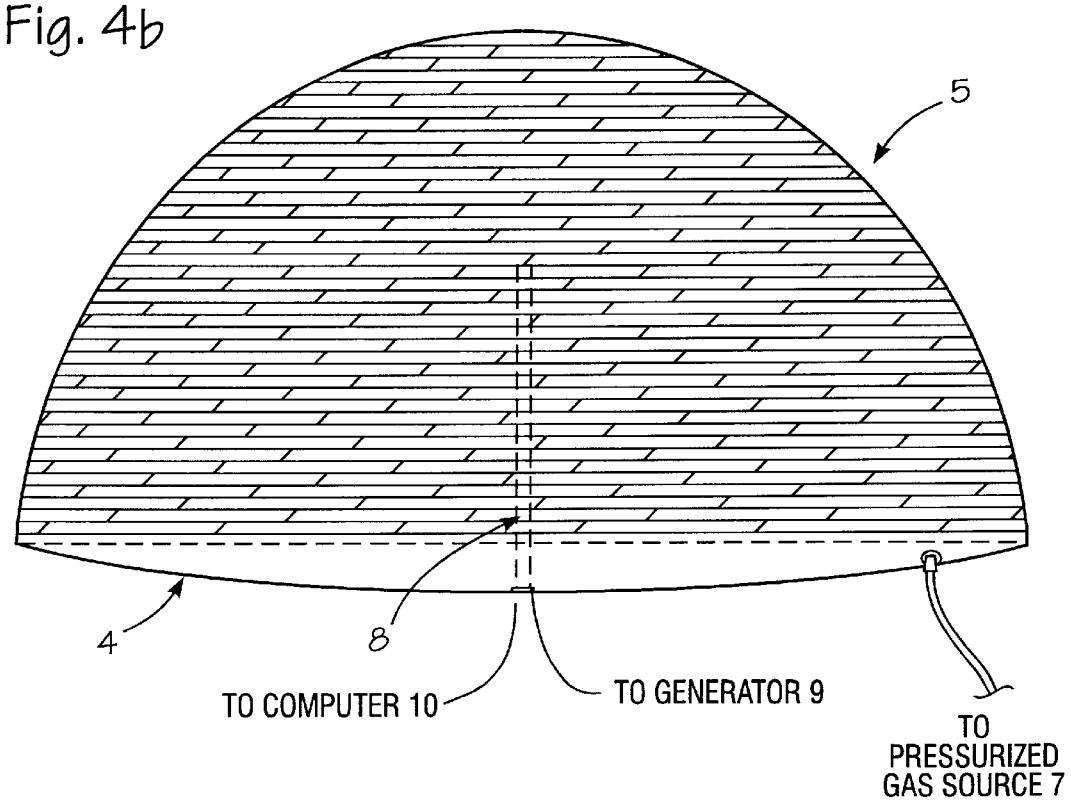
Figure 4C:
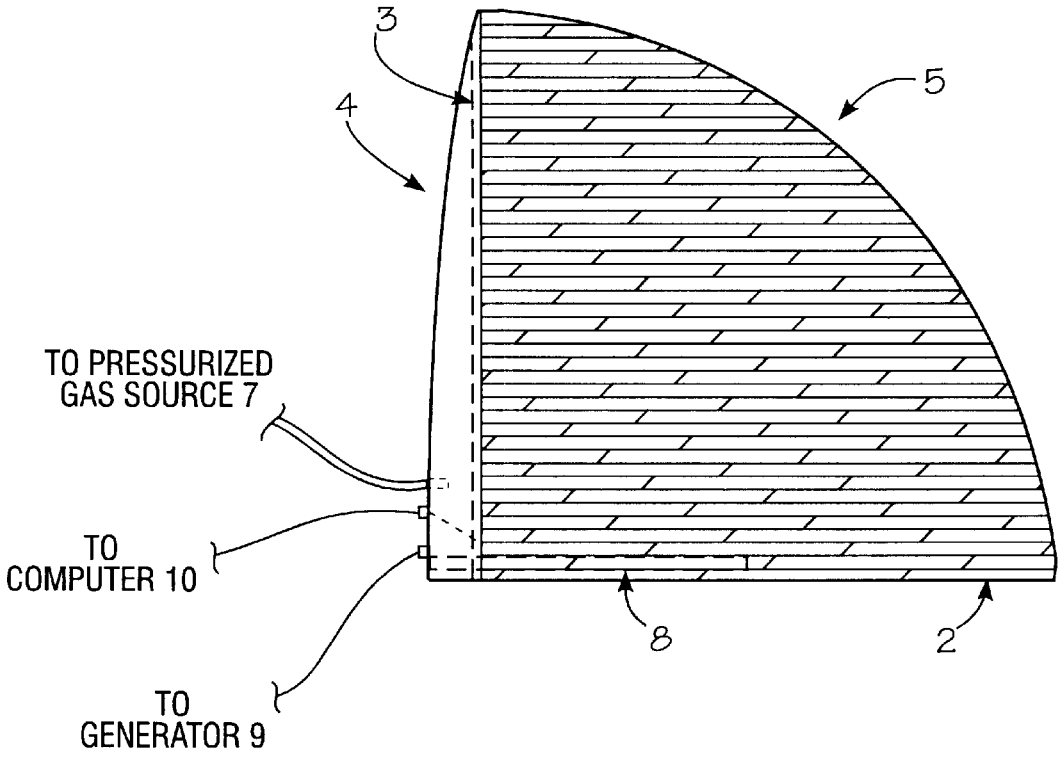

FIGS. 4A, 4B, and 4C illustrate an embodiment of the apparatus's inflatable antenna reflector that in this case has a reflective rear portion 5 with a spherical surface. In this configuration, the antenna feed 8 is linear and extends along the central axis of the spherical surface. Cylindrical-shaped electromagnetic wavefronts generated by the feed impinge upon and reflect from the reflective spherical rear portion to generate plane waves that can be used to test a target for its radar signature. The linear feed can be attached with electromagnetic-wave transmissive straps or brackets, for example, to the base 2. Although not shown in FIGS. 4A–4C, the apparatus can include a serrated pattern or rounded edge to prevent edge effects. In other respects, the embodiment of FIGS. 4A–4C can be similar to the embodiments previously described.

Advantageously, the invented apparatus is light weight and therefore highly portable. Also, the invented apparatus is relatively simplified in the number of parts required to be set-up or disassembled. As such, the invented apparatus can be used for compact range testing in a building or on a piece of land that can be used for other purposes in addition to compact range testing. Further, the base of the apparatus extends along the largest dimension of the inflated base-frame-cover assembly and can be weighted so that it has a relatively low center of gravity and is stable without requiring attachment to a stand or the like, or without being secured to the floor of a building or fixed in the ground of an outdoor range. In addition, the frame extends circularly along 180° of arc or less relative to its center of curvature, a feature which also helps to enhance the apparatus'stability. The apparatus can be provided with an appropriate serrated edge pattern or a rounded edge to reduce edge effects to greatly enhance the size of the space in which electromagnetic waves generated by the apparatus are planar and therefore useful for compact range testing. Furthermore, the reflective portion of the cover can be non-stretchable so that the cover does not distort from the desired parabolic or spherical configuration upon inflation. Moreover, the electromagnetic-wave reflective material can be provided in the cover through reinforcing metal or alloy strands that also provide non-stretchable behavior, or through flame-spraying or metal or alloy coating that can be applied uniformly, rapidly, and that can be easily applied in a manner so as to form the serrated pattern useful for reducing edge effects.

The many features and advantages of the present invention are apparent from the detailed specification and thus, it is intended by the appended claims to cover all such features and advantages of the described apparatuses which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

I claim:

1. An apparatus supported by a level surface, the apparatus comprising:

a base having a planar surface resting on the level surface;

an elongated frame having first and second ends mounted to the base at spaced positions thereof so that the frame extends upwardly from the base in an arch-like configuration;

a cover supported by the frame and having a peripheral edge coupled about edge portions of the base, the cover having an electromagnetic-wave reflective portion on one side of the frame and an electromagnetic-wave transmissive portion on the opposite side of the frame; and a pressurized gas source coupled to communicate with a space enclosed by the cover and the base, and inflating the cover so that the rear reflective portion assumes a predetermined smoothly-curved shape.

2. An apparatus as claimed in claim 1, wherein the base is composed of plastic.

3. An apparatus as claimed in claim 1, wherein the base is composed of aluminum.

4. An apparatus as claimed in claim 1, wherein the base has a curved rear edge portion coupled to the peripheral edge of the reflective portion of the cover, and the base has a front edge portion coupled to the peripheral edge of the transmissive portion of the cover.

5. An apparatus as claimed in claim 4, wherein the rear edge portion of the base has a parabolic configuration.

6. An apparatus as claimed in claim 4, wherein the rear edge portion of the base has a circular configuration.

7. An apparatus as claimed in claim 1, wherein the frame has a circular configuration.

8. An apparatus as claimed in claim 7, wherein the frame extends for 180° of arc or less relative to its center of curvature that is positioned on the opposite side of the base from that at which the frame is attached.

9. An apparatus as claimed in claim 1, wherein the frame is composed of a plastic tube.

10. An apparatus as claimed in claim 1, wherein the frame is composed of an aluminum tube.

11. An apparatus as claimed in claim 1, wherein the first and second ends of the frame are welded to the base.

12. An apparatus as claimed in claim 1, wherein the first and second ends of the frame are fused to the base.

13. An apparatus as claimed in claim 1, wherein the first and second ends of the frame are adhered to the base.

14. An apparatus as claimed in claim 1, further comprising:

first and second brackets coupled between the base and the first and second ends of the frame, respectively.

15. An apparatus as claimed in claim 1, wherein the frame is inflatable.

16. An apparatus as claimed in claim 1, wherein the center of gravity of the base, frame and cover, is less than one-half of the distance from the base to the frame's apex.

17. An apparatus as claimed in claim 1, wherein the electromagnetic-wave-reflective portion of the cover is composed of a non-stretchable sheet-like material.

18. An apparatus as claimed in claim 1, wherein the electromagnetic-wave-reflective portion of the cover is composed of a substantially sheet-like material flame-sprayed with metal.

19. An apparatus as claimed in claim 18, wherein the metal is zinc.

20. An apparatus as claimed in claim 18, wherein the sheet-like material is a plastic fabric.

21. An apparatus as claimed in claim 1, wherein the electromagnetic-wave-reflective portion of the cover is composed of a sheet-like material treated with a curable metal-containing substance.

22. An apparatus as claimed in claim 21, wherein the substance is non-oxidizing.

23. An apparatus as claimed in claim 1, wherein the electromagnetic-wave-reflective portion of the cover includes metal fibers.

24. An apparatus as claimed in claim 1, wherein the cover is substantially air-tight.

25. An apparatus as claimed in claim 1, wherein the cover is sheet-like.

26. An apparatus as claimed in claim 1, wherein at least the rear portion of the cover is made of a plurality of substantially sheet-like pieces of material joined together at adjacent peripheral edges.

27. An apparatus as claimed in claim 26, wherein the pieces of material are joined together with adhesive.

28. An apparatus as claimed in claim 26, wherein the pieces of material are joined together by sewing.

29. An apparatus as claimed in claim 26, wherein the pieces of material are fused together.

30. An apparatus as claimed in claim 26, wherein the pieces of material are substantially triangular.

31. An apparatus as claimed in claim 1, wherein at least the rear portion of the cover is made of at least one layer of substantially sheet-like pieces of non-stretchable material adhered to at least one layer of curable plastic material.

32. An apparatus as claimed in claim 31, wherein the rear portion of the cover includes alternating layers of the sheet-like pieces of material and curable plastic material.

33. An apparatus as claimed in claim 31, wherein the sheet-like pieces of material include at least one of carbon, fiberglass, and silk fabrics.

34. An apparatus as claimed in claim 31, wherein the curable plastic material includes urethane.

35. An apparatus as claimed in claim 1, wherein the electromagnetic-wave-reflective portion of the cover has a serrated pattern at portions of the cover positioned in close proximity to the frame, the serrated pattern of the cover formed by alternating electromagnetic-wave transmissive or absorptive portions and electromagnetic-wave-reflective portions of the cover.

36. An apparatus as claimed in claim 1, wherein the frame is tube-shaped and formed of an electromagnetic-wave-reflective material, to provide a rounded edge for the electromagnetic-wave-reflective portion of the cover.

37. An apparatus as claimed in claim 1, further comprising:

at least one strip attached to the base to secure the periphery of the cover to the edge portions of the base.

38. An apparatus as claimed in claim 37, wherein the strip is attached to the edge portions of the base with screws extending through the strip and the cover, and into the edge portions of the base.

39. An apparatus as claimed in claim 1, wherein the reflective portion of the inflated cover has a substantially parabolic surface, the apparatus further comprising:

an antenna feed positioned substantially at the focal point of the substantially parabolic surface defined by the reflective portion of the cover.

40. An apparatus as claimed in claim 39, wherein the antenna feed generates and directs electromagnetic waves with an approximately spherical wavefront to the reflective portion of the inflated cover, and wherein the reflective portion reflects the spherical wavefront so that the reflected electromagnetic waves have an approximately planar wavefront.

41. An apparatus as claimed in claim 40, wherein the reflective portion generates a quiet zone in which the electromagnetic waves are at least approximately planar, wherein a target is positioned in the quiet zone, and wherein the target reflects planar waves to the feed via the reflective portion of the inflated cover, the feed generating a signal indicative of the signature of the target.

42. An apparatus as claimed in claim 41, further comprising:

a computer coupled to receive the signal generated by the feed, the computer storing the signal.

43. An apparatus as claimed in claim 42, wherein the target is positioned in a plurality of different orientations, and wherein the computer stores the signals from the feed for the different target orientations.

44. An apparatus as claimed in claim 1, wherein the reflective portion of the inflated cover has a substantially spherical surface, the apparatus further comprising:

a line antenna feed positionally fixed on the base, and extending along a central axis of the spherical surface.

45. An apparatus as claimed in claim 44, wherein the antenna feed generates and directs electromagnetic waves with an approximately cylindrical wavefront to the reflective portion of the inflated cover, and wherein the reflective portion reflects the cylindrical wavefront so that the reflected electromagnetic waves have an at least approximately planar wavefront.

46. An apparatus as claimed in claim 45, wherein the reflective portion generates a quiet zone in which the electromagnetic waves are approximately planar, wherein a target is positioned in the quiet zone, and wherein the target reflects planar waves to the feed via the reflective portion of the inflated cover, the feed generating a signal indicative of the signature of the target.

47. An apparatus as claimed in claim 46, further comprising:

a computer coupled to receive the signal generated by the feed, the computer storing the signal.

48. An apparatus as claimed in claim 47, wherein the target is positioned in a plurality of different orientations, and wherein the computer stores the signals from the feed for the different target orientations.

49. An apparatus as claimed in claim 1, further comprising:

an antenna feed positioned to oppose the reflective portion of the cover.

50. An apparatus as claimed in claim 49, further comprising:

first and second spaced blocks coupled to the front edge portion of the base; and a beam situated between the blocks and extending along the level surface, the beam having an end upon which the antenna feed is mounted.

51. An apparatus as claimed in claim 1, wherein the pressurized gas source includes a pressure regulator to control the gas pressure in the space enclosed by the cover and the base to a predetermined pressure level.

52. An apparatus as claimed in claim 1, wherein the source includes an air pump.

53. An apparatus as claimed in claim 1, wherein the source includes a pressurized gas tank.

54. An apparatus supported by a level surface, the apparatus comprising:

a base having a substantially planar shape with first and second opposite major surfaces, the first major surface for resting on the level surface, the base further having a front edge portion and a curved rear edge portion extending between the first and second major surfaces;

an elongated frame having first and second ends attached at to the base at separated positions thereon, the frame extending upwardly from the base in an arched configuration;

a cover supported by the frame and attached at a peripheral portion thereof to the edge portions of the base, the cover having a substantially electromagnetic-wave-reflective portion extending between the frame and the curved rear edge portion of the base, and an electromagnetic-wave transmissive portion extending between the frame and the front edge portion of the base; and a pressurized gas source coupled to communicate with the space enclosed by the second major surface of the base and the cover, the source pressurizing the space enclosed by the second major surface of the base and cover so that the electromagnetic-wave-reflective portion inflates to form a substantially smoothly-curved surface.

* * * * *